US009486711B2

(12) United States Patent
Brassard et al.

(10) Patent No.: US 9,486,711 B2
(45) Date of Patent: Nov. 8, 2016

(54) AMUSEMENT RIDE BACK SHIELD

(71) Applicant: Whitewater West Industries Ltd., Richmond (CA)

(72) Inventors: Daniel P. Brassard, Burnaby (CA); Raymond J. DuBois, Port Coquitlam (CA); Timothy B. Kwasnicki, Delta (CA); Richard A. Sebulsky, Delta (CA)

(73) Assignee: Whitewater West Industries Ltd., Richmond, BC (CA)

( * ) Notice: Subject to any disclaimer, the term of this patent is extended or adjusted under 35 U.S.C. 154(b) by 0 days.

(21) Appl. No.: 13/847,972

(22) Filed: Mar. 20, 2013

(65) Prior Publication Data

US 2014/0194216 A1 Jul. 10, 2014

Related U.S. Application Data

(60) Provisional application No. 61/612,976, filed on Mar. 20, 2012.

(51) Int. Cl.
*A63G 21/18* (2006.01)
*A63G 21/00* (2006.01)

(52) U.S. Cl.
CPC ..... *A63G 21/18* (2013.01); *A63G 21/00* (2013.01)

(58) Field of Classification Search
CPC ..... A63G 21/18
USPC ..... 472/88
See application file for complete search history.

(56) References Cited

U.S. PATENT DOCUMENTS

| | | | | |
|---|---|---|---|---|
| 3,497,211 | A * | 2/1970 | Nagin | 472/90 |
| 4,506,664 | A * | 3/1985 | Brault | 5/628 |
| 6,334,799 | B1 * | 1/2002 | Delpozo | B63B 35/7916 441/65 |
| 6,871,368 | B2 * | 3/2005 | Calkin | 5/628 |
| D693,741 | S * | 11/2013 | Carrier | D12/128 |

* cited by examiner

*Primary Examiner* — Michael Dennis
(74) *Attorney, Agent, or Firm* — Greenberg Traurig LLP

(57) ABSTRACT

A system for shielding a rider's back from a ride surface. The system includes a slide ride having an entrance and an exit and configured such that the rider's back slides substantially parallel along a slide ride surface when the rider slides from the entrance towards the exit. The system includes a plurality of shielding devices disposed relative to the slide ride such that the rider may put on one of the plurality of shielding devices prior to sliding on the slide ride, each of the plurality of shielding devices configured to be worn by the rider such that the shielding device covers the rider's back, and adapted to slide upon the slide ride surface to shield the rider's back from the slide ride surface when the rider slides from the entrance to the exit.

18 Claims, 18 Drawing Sheets

AMUSEMENT RIDE BACK SHIELD

CROSS REFERENCE TO RELATED APPLICATIONS

This application claims the benefit of U.S. Provisional Patent Application Ser. No. 61/612,976, filed on Mar. 20, 2012, entitled "AMUSEMENT RIDE BACK SHIELD," which is hereby incorporated by reference in its entirety.

BACKGROUND

1. Field of the Invention

The present invention relates to an apparatus and method for riding upon an amusement ride. More particularly, the present invention relates to an apparatus and method for shielding a rider's back during transit on a ride surface of an amusement ride.

2. Description of the Related Art

The popularity of family-oriented theme parks and recreational facilities has increased dramatically in the last decade. In particular, water parks have proliferated as adults and children, alike, seek the thrill and entertainment of water parks as a healthy and enjoyable way to cool off in the hot summer months.

Most theme parks consist primarily of ride attractions. Some of the more popular among these are slides in which participants slide down a trough or tunnel. In a waterpark, the rider may slide upon water on the slide, and splash down into a pool of water. As demand for such attractions has increased, parks have continued to evolve ever larger and more complex slides to thrill and entertain growing numbers of water play participants.

Many slide rides attract customers by offering high speed travel through the slide. The customers may slide with their backs, or other portion of their body, riding upon the surface of the slide ride. Such a riding position, however, may cause discomfort to the rider or interfere with the clothing worn by the rider, slowing the rider's overall speed and thrill during travel.

SUMMARY

Embodiments of the present invention are directed to a system for shielding a portion of a rider, such as the rider's back, from a ride surface. By shielding a portion of the rider from the ride surface, friction may be reduced, allowing for a more thrilling ride experience and/or the comfort of the rider while riding may be increased. For example, the system includes a slide ride having an entrance and an exit, and configured such that the rider's back slides parallel along a slide ride surface when the rider slides from the entrance towards the exit. The system includes a plurality of shielding devices disposed relative to the slide ride such that the rider may put on one of the plurality of shielding devices prior to sliding on the slide ride, each of the plurality of shielding devices configured to be worn by the rider such that the shielding device covers the rider's back, and adapted to slide upon the slide ride surface to shield the rider's back from the slide ride surface when the rider slides from the entrance to the exit.

In one embodiment, a device for shielding a part of a body of a rider from a ride surface may include a board configured to be coupled with the body of the rider, the board having an outer surface configured to slide on the ride surface and having an inner surface configured to cover the part of the body of the rider when the rider is coupled with the board.

A securing mechanism may be coupled with the board for securing the board to the rider when the rider is coupled with the board.

In another embodiment, a system for protecting a back of a rider from a slide ride, the system may include a sliding surface extending from an entrance of the slide ride to an exit of the slide ride, the sliding surface configured to support the back of the rider as the rider slides along the sliding surface from the entrance towards the exit. The system may also include a shielding device disposed adjacent to the slide ride for the rider to wear prior to sliding on the sliding surface, the shielding device configured to cover the back of the rider when worn by the rider and configured to slide upon the sliding surface for protecting the back of the rider from the sliding surface when the rider slides from the entrance towards the exit.

In still another embodiment, a method of shielding a body of a rider on a slide ride, may include the steps of providing a sliding surface, the sliding surface configured to support the body of the rider substantially parallel along the sliding surface when the rider slides on the sliding surface, and providing a shielding device configured to be worn by the rider prior to the rider sliding on the sliding surface, the shielding device having a first surface made of a first material configured to cover a portion of the body of the rider and a second surface made of a second material configured to contact the sliding surface when the rider slides on the sliding surface.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale and may be exaggerated to better illustrate the important features of the present invention. In the drawings, like reference numerals designate like parts throughout the different views, wherein:

FIG. 9A-2 is a side view of the shielding device of FIG. 9A-1 from the perspective of Line A-A according to an embodiment of the present invention;

FIG. 9A-3 is a top view of the shielding device of FIG. 9A-1 from the perspective of Line B-B according to an embodiment of the present invention;

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1A:
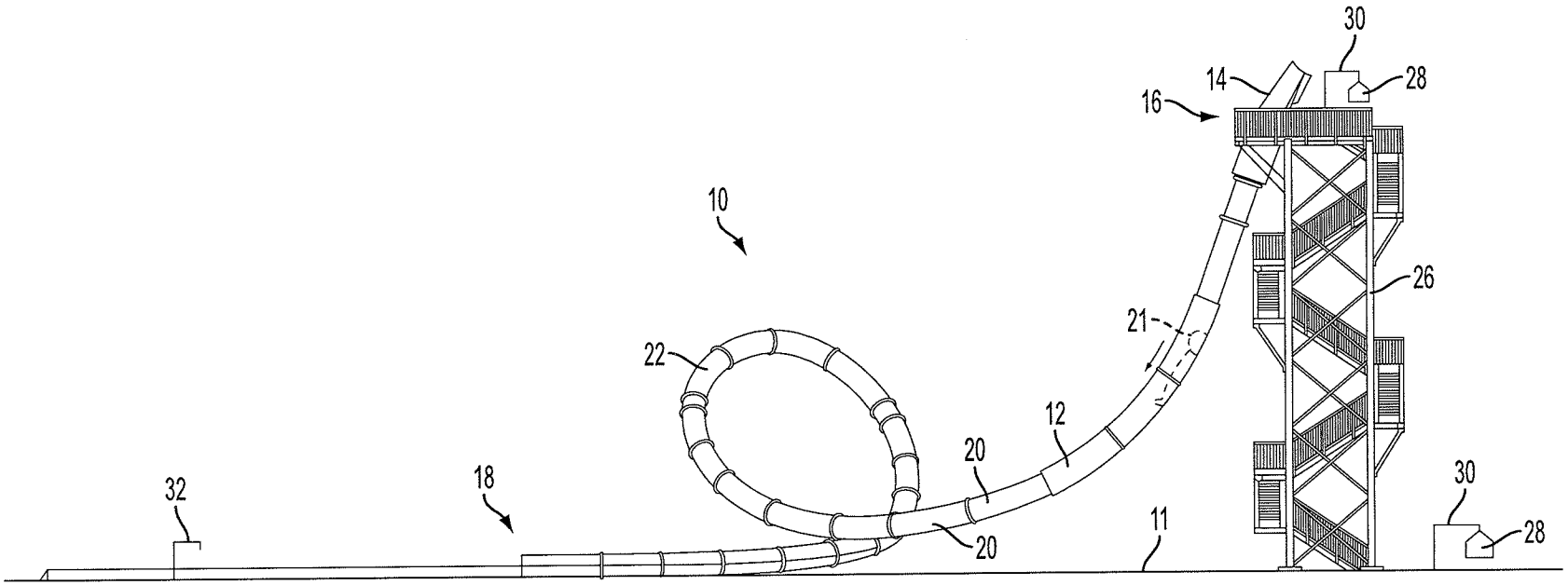
FIG. 1A is a side view of a slide ride using a loop according to an embodiment of the present invention.

Turning first to FIG. 1A, one embodiment of the present invention is shown, displaying a slide ride 10 including a flume 12 and an entry device 14. In one embodiment, the slide ride 10 may comprise a waterslide that allows a rider to slide thereon upon a layer of water. In an alternative embodiment, the slide ride 10 may comprise a dry slide ride, or a slide the rider slides upon without water. The flume 12 comprises a structure a rider may slide upon, to travel from an entrance 16 to an exit 18 of the flume 12. The flume 12 may comprise a fully enclosed (as shown in FIG. 1A), or partially enclosed structure, such as a half pipe or half shell. As shown in FIG. 1A, the flume may be formed from a plurality of flume, or slide segments 20. In an embodiment in which the ride comprises a waterslide, the slide segments 20 may be waterslide segments. A plurality of slide segments 20 are joined end to end, forming a channel or path, for the rider to follow when traveling from the entrance 16 to the exit 18. The individual slide segments 20 may be shaped differently, or similarly, depending on the desired path for the rider to follow. For example, in the embodiment shown in FIG. 1A, the slide segments 20 are shaped to create a loop 22 for the rider to travel through.

The slide ride 10 is configured such that the rider slides upon a surface of the slide ride 10 with his or her back parallel or substantially parallel to the slide ride 10 surface. The rider therefore slides in a recumbent position to allow the rider's feet to lead as the rider traverses the slide ride 10. The rider 21, shown in outline in FIG. 1A, is shown to move with his back parallel to the surface of the slide ride 10. In a waterslide embodiment, the rider may slide upon a surface of the flume 12 in conjunction with a flow or a layer of water. The water reduces friction between the rider and the surface of the flume 12, allowing the rider to achieve great speeds as he or she traverses from the entrance 16 to the exit 18.

In the embodiment shown in FIG. 1A, the entrance 16 of the flume 12 is elevated above ground level 11. The entrance 16 is elevated such that a rider experiences a force of gravity that draws the rider from the entrance 16 to the exit 18. Accordingly, in the embodiment shown in FIG. 1A, the entrance 16 is positioned atop a tower 26 the rider will climb to reach the entrance 16 of the flume 12. During the rider's ascent of the tower 26, the rider gains gravitational potential energy. This gravitational potential energy allows the rider to later travel through the flume 12, and pass through the loop 22 rapidly, eventually sliding into the exit 18 of the flume 12. The speed and centripetal forces experienced by the rider enhance his or her overall enjoyment.

The entry device 14 may comprise a trapdoor mechanism or the like capable of quickly dropping the rider into the slide ride 10. In other embodiments, the entry device 14 may simply comprise an opening or aperture allowing a rider to enter the slide ride 10.

Once the rider passes through the entry device 14, the rider will descend quickly through the slide ride 10. However, because the rider slides with his or her back substantially parallel to the surface of the slide ride 10, there may be large amounts of friction formed between the rider's back and the surface of the slide ride 10. The friction of the rider's back and the slide ride may cause discomfort to the rider, interfere with clothing worn by the rider, or otherwise reduce the speed or thrill experienced by the rider.

To reduce or lesson one or more of these effects, it may be desirable to provide a shielding device 28 configured to be worn by the rider to shield the rider's back during transit on the slide ride 10. In certain embodiments, the shielding device 28 may comprise a device configured to be worn by the rider in order to cover the rider's back, and forming a layer of material between the rider's back and the surface of the slide ride. The shielding device 28 may have an outer surface adapted to slide on the slide ride 10 surface. For example, the shielding device 28 may have a smooth outer surface capable of easily gliding on the slide ride 10 surface.

In this manner, the rider's back, and/or the clothing on the rider's back are protected from damage from friction produced against the slide ride 10 surface. In certain embodiments, the shielding device 28 may comprise a board configured to be worn by the rider, to cover the rider's back, and forming a layer of material between the rider's back and the surface of the slide ride.

A plurality of shielding devices 28 may be positioned near or adjacent to the slide ride 10 to allow a rider to receive a shielding device 28 and wear the shielding device 28 prior to traveling on the slide ride 10. The shielding devices 28 may be disposed within sufficient distance from the slide ride 10 such that a rider could put on the shielding device 28 prior to entering the slide ride 10. Such locations may be near the slide ride 10 or upon the slide ride tower 26. In certain embodiments, a shielding device access area 30 in the form or a rack or other housing for allowing access to the shielding devices 28 may be positioned near the slide ride 10, for example the slide ride tower 26, to allow a rider to obtain a shielding device 28. In certain embodiments, a receiving area 32 may be positioned near or adjacent to the exit 18, to receive the shielding devices 28 after the rider removes the shielding device 28 after traveling on the slide ride 10. The receiving area 32 may be in the form of a rack or other housing. An individual (e.g., an employee of the waterpark or amusement park) may convey the shielding device 28 from the receiving area 32 back to the access area 30, to replenish the supply of shielding devices 28 for use by riders on the slide ride 10.

Figure 1B:
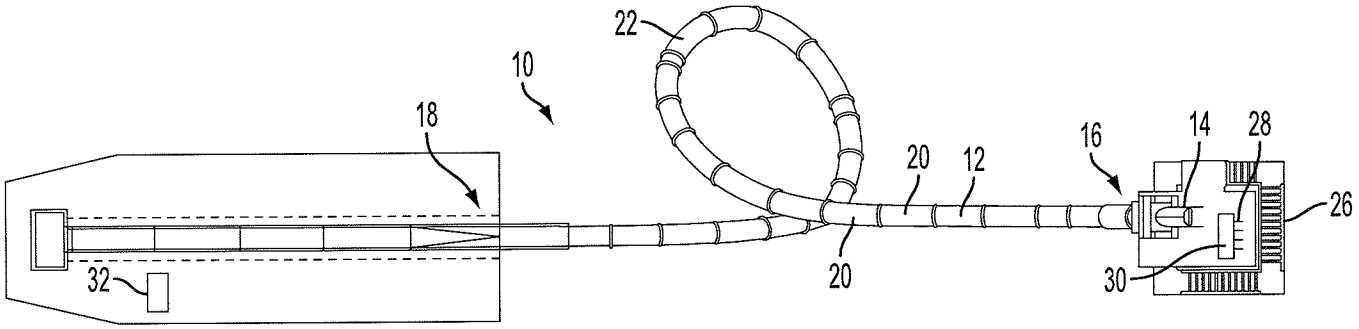
FIG. 1B is a top view of the slide ride of FIG. 1A according to an embodiment of the present invention.

FIG. 1B shows a top view of the slide ride 10 shown in FIG. 1A and includes the same features as previously discussed above for FIG. 1A. Any of a variety of slide rides, particularly waterslide rides, may be used in combination with a shielding device, for example the shielding device 28 as discussed above for FIGS. 1A and 1B. For example, one slide ride may comprise an enclosed, vertical or near-vertical drop waterslide that a rider slides upon with his or her back parallel or substantially parallel to the surface of the waterslide. In another example, a slide ride may comprise an open, vertical or near-vertical drop waterslide that a rider slides thereon with his or her back parallel or substantially parallel to the surface of the waterslide. In still another example, a slide ride may be a looping waterslide (e.g., the same or similar as shown in FIGS. 1A and 1B) that a rider slides upon with his or her back parallel or substantially parallel to the surface of the waterslide. Such loops may include, for example, vertical loops, near-vertical loops, or flatline loops. The rider may descend face-up, feet-forward when traveling on the various waterslides discussed.

Figure 1C:
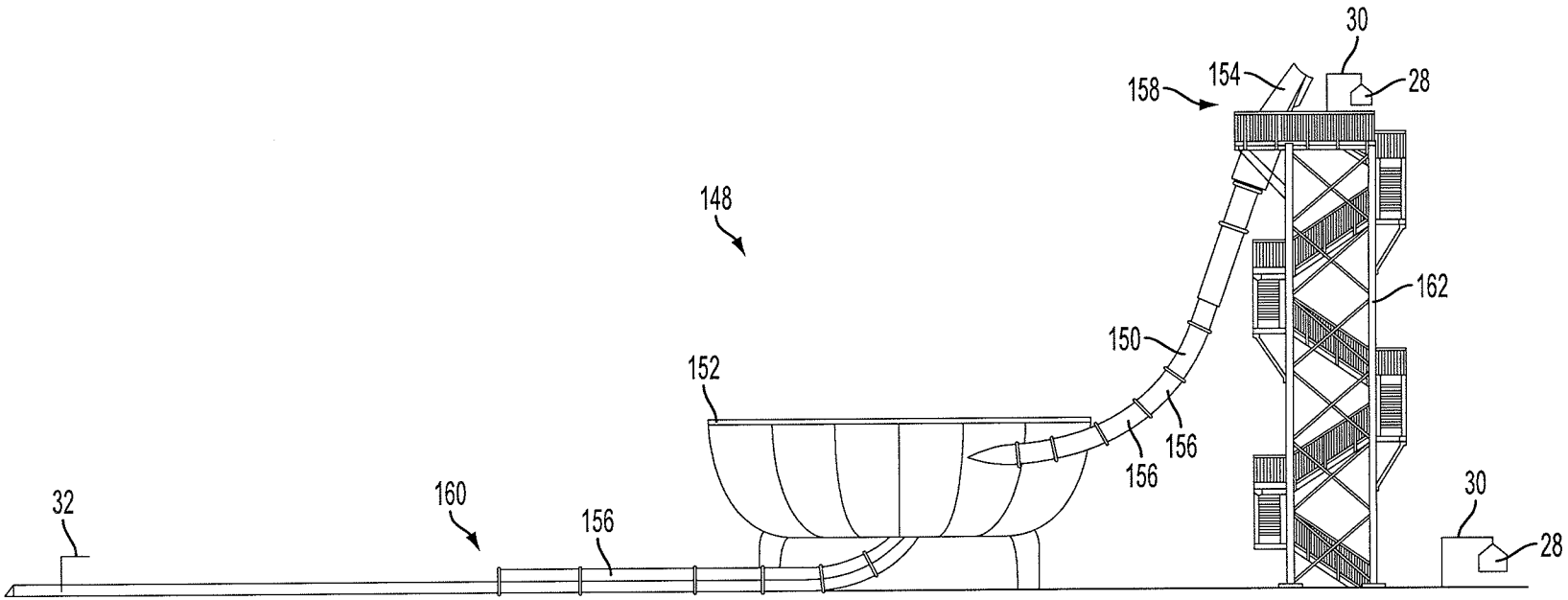
FIG. 1C is a side view of a slide ride using a waterslide bowl according to an embodiment of the present invention.
Figure 1D:
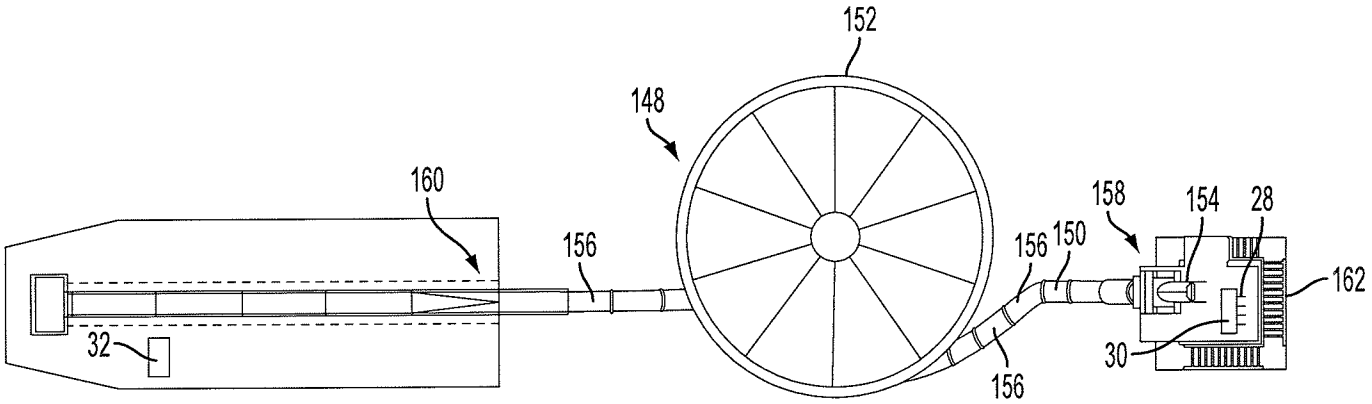
FIG. 1D is a top view of the slide ride of FIG. 1C according to an embodiment of the present invention

FIGS. 1C and 1D illustrate an embodiment of the present invention including a slide ride in the form of a waterslide ride 148, configured as a flume 150 and including a waterslide bowl 152. The waterslide ride 148 may include an entry device 154 that operates similarly as the entry device 14 described in regard to FIGS. 1A and 1B. In this embodiment, flume segments, or waterslide segments 156 stem from an entrance 158 of the waterslide ride 148 and lead to the waterslide bowl 152. The rider is configured to slide around an inner circumference of the waterslide bowl 152 before traveling to an exit 160 of the ride 148. Waterslide segments 156 additionally lead from the waterslide bowl 152 to the exit 160.

As discussed in regard to FIGS. 1A and 1B, a plurality of shielding devices 28 may be positioned near the waterslide ride 148 to allow a rider to receive a shielding device 28 and wear the shielding device 28 prior to traveling on the waterslide ride 148. The shielding devices 28 may be disposed within sufficient distance from the waterslide ride 148 such that a rider could put on the shielding device 28 prior to entering the waterslide ride 148. Such locations may be near or adjacent to the waterslide ride 148 or upon a waterslide ride tower 162. In certain embodiments, shielding device access areas 30 in the form or a rack or housing for allowing access to the shielding devices 28 may be positioned near or adjacent to the waterslide ride 148, for example on the waterslide ride tower 162 to allow a rider to obtain a shielding device 28. In certain embodiments, a receiving area 32 may be positioned near the exit 160 to receive one of the shielding devices 28 after the rider removes the shielding device 28 after traveling on the waterslide ride 148. An individual may convey the shielding device 28 from the receiving area 32 back to the access area 30 to replenish the supply of shielding devices 28. Approximately 100 shielding devices 28 may provide a sufficient number of devices 28 for use with a fully operational slide ride, although this number may be varied as desired. Various sizes of shielding devices 28, for example adult size or child size may be disposed around the waterslide ride 148 as desired.

Figure 2:
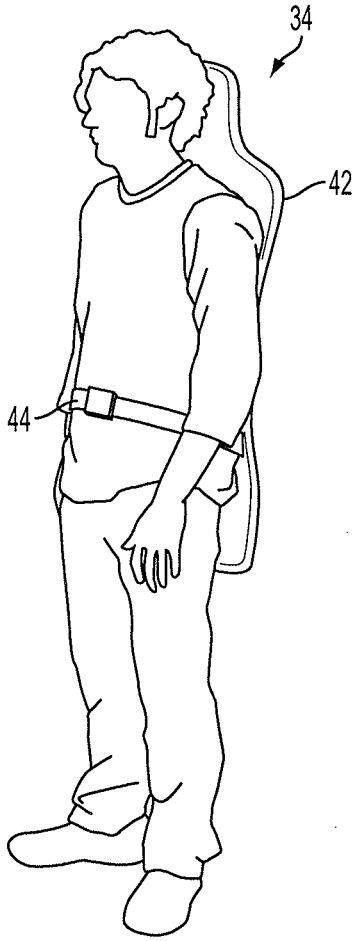
FIG. 2 is a perspective view of a shielding device according to an embodiment of the present invention.

FIG. 2 shows an embodiment of a shielding device 34 being worn by a user. The shielding device 34 may include the same or similar features and/or may be configured to be utilized the same or similar as previously discussed for FIGS. 1A and 1B. The shielding device 34 is configured as a board 42 the user wears in order to cover the user's back during transit on a slide ride. A securing mechanism 44, such as a belt or other strap around a waist of the user secures the board 42 to the user when the rider wears the board 42. The board 42 has an outer surface adapted to slide upon a surface of a slide ride to shield and protect the rider from damage from the surface of the slide ride. The board 42 is sized to fit within a slide ride, and is adapted to not produce abrasions or damage to the surface of the slide ride when it slides thereupon.

In the embodiment shown in FIG. 2, the board 42 is flexible for allowing the board 42 to contour to the shape of the user's back and/or the surface of the slide ride for transit upon the slide ride. The board 42 may be comprised of a foam material that provides cushioning for the user's back during transit upon the slide ride. The board 42 is shaped to cover the user's head, back, and buttocks. The securing mechanism 44 comprises a waist strap that secures the board 42 to the user. The securing mechanism 44 is adjustable to allow for different sized users to use the board 42.

Figure 3A:
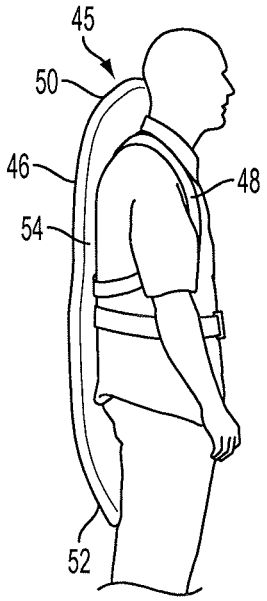
FIG. 3A is a side view of a shielding device according to an embodiment of the present invention.
Figures 3, 9A:
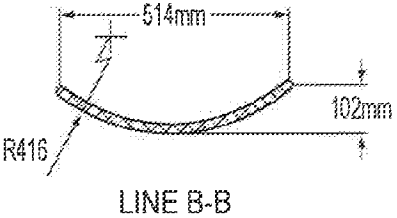
Figures 2, 9A:
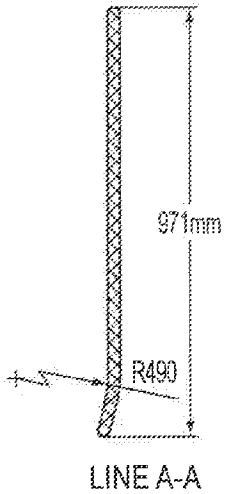
FIG. 9A-1 is a perspective view of a shielding device according to an embodiment of the present invention.

FIG. 3A shows an embodiment of a shielding device 45 being worn by a user. The shielding device 45 may include the same or similar features and/or may be configured to be utilized the same or similar as previously discussed. The shielding device 45 shown in FIG. 3 is configured as a board 46 the user wears to cover the user's back during transit on a slide ride. A securing mechanism 48, for example a chest strap, secures the board 46 to the rider when the rider wears the board 46. The board 46 has an outer surface adapted to slide upon a surface of a slide ride, to shield and protect the rider from damage from the surface of the slide ride. The board 46 is sized to fit within a slide ride and will not produce abrasions or damage to the surface of the slide ride when it slides thereupon.

In the embodiment shown in FIG. 3A, the board 46 includes curved upper 50 and lower 52 portions to account for the various angles of the slide ride that the rider will encounter while traversing the slide ride. The board 46 covers the head and the buttocks of the rider. A pad 54 is positioned between the board 46 and the rider to provide further cushioning for the rider while he traverses the slide ride.

Figure 3B:
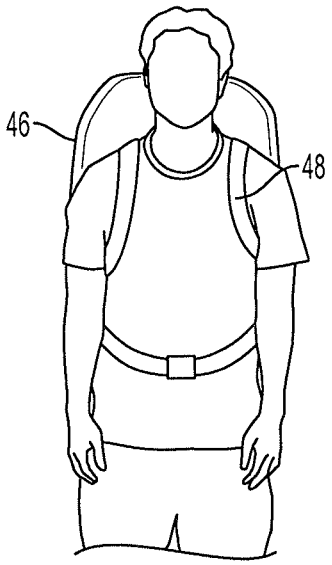
FIG. 3B is a front view of the shielding device of FIG. 3A according to an embodiment of the present invention.
Figure 6:
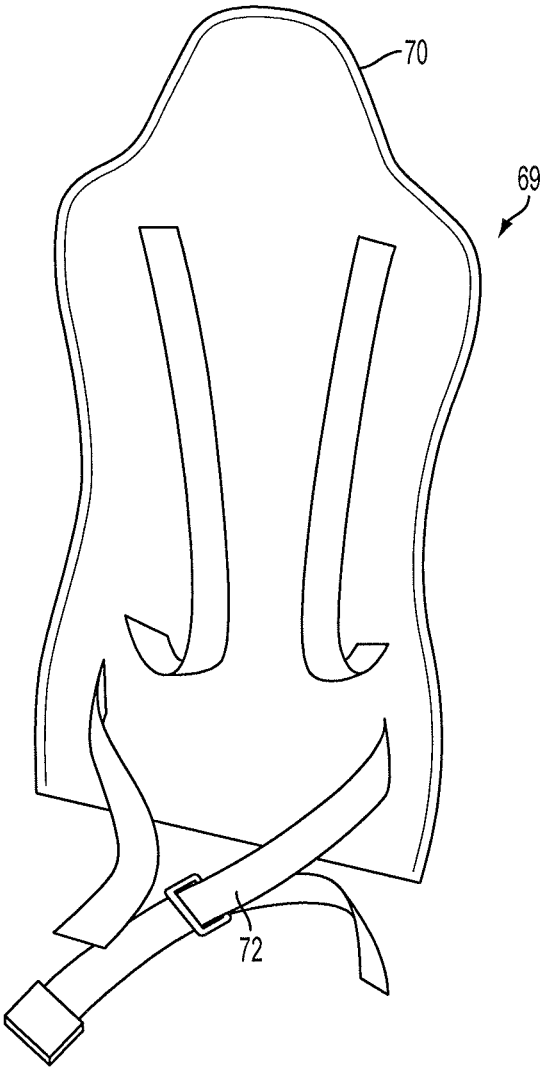
FIG. 6 is a perspective view of a shielding device according to an embodiment of the present invention.

FIG. 3B shows a front view of the rider shown in FIG. 6, while wearing the board 46. The board 46 is shown to have dimensions that exceed the dimensions of the rider's body, for example, the rider's torso. The securing mechanism 48 is shown to comprise a plurality of straps, including a waist strap and two chest, or shoulder straps. Each of the straps is adjustable to account for various sizes of riders to which the board 46 may be secured.

Figure 4A:
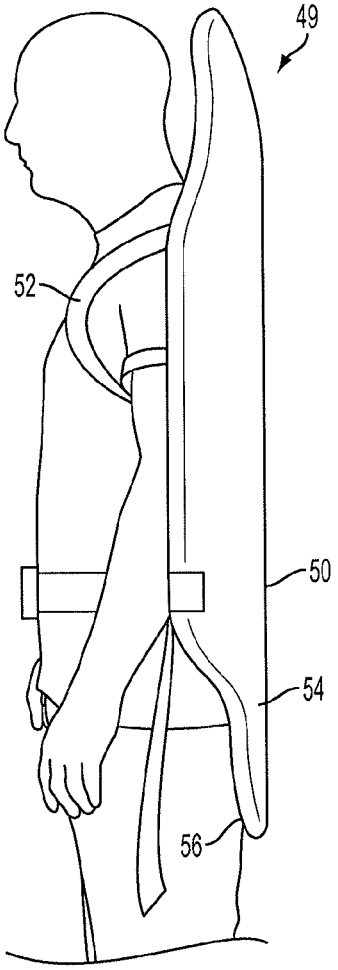
FIG. 4A is a side view of a shielding device according to an embodiment of the present invention.

FIG. 4A shows a side view of an embodiment of a shielding device 49 being worn by a user. The shielding device 49 may include the same or similar features and/or may be configured to be utilized the same or similar as previously discussed. The shielding device 49 shown in FIG. 8 is configured as a board 50 the user wears to cover the user's back during transit on a slide ride. A securing mechanism 52 (e.g., shoulder straps) secures the board 50 to the user when the user wears the board 50. The board 50 has an outer surface 54 adapted to slide upon a surface of a slide ride in order to shield and protect the user from damage from the surface of the slide ride. The board 50 is sized to fit within a slide ride and will not produce abrasions or damage to the surface of the slide ride when it slides thereupon.

In the embodiment shown in FIG. 4A, the outer surface 54 of the board 50 is shown to comprise a substantially flat surface, adapted to slide upon the surface of a slide ride. In this embodiment, the board 50 is made of foam, to provide a cushion for the user while traversing the slide ride. The inner surface 56 of the board 50 is shown to be substantially flat, to lie against and cover the user's back. The board 50 covers and protects the user's head, back, and buttocks.

Figure 4B:
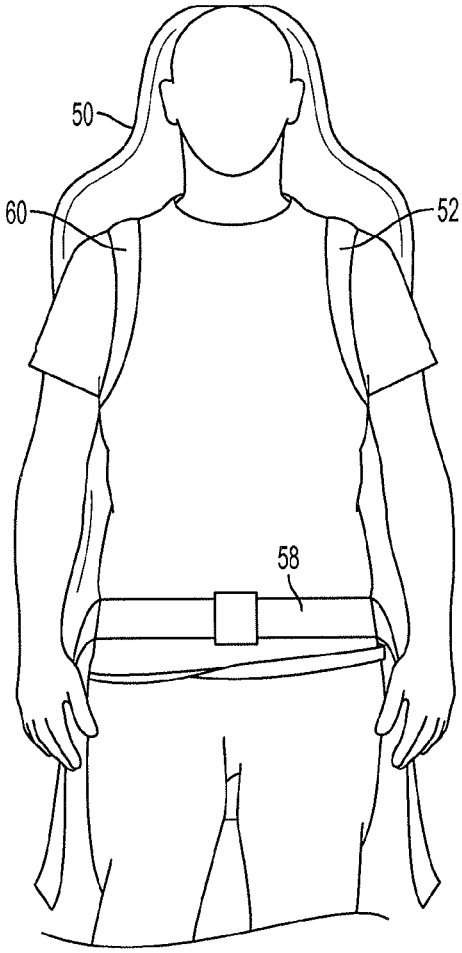
FIG. 4B is a front view of the shielding device of FIG. 4A according to an embodiment of the present invention.

FIG. 4B shows a front view of the user wearing the shielding device 49 described above in FIG. 4A. As shown, the board 50 extends outward, to have a greater profile than the user's body. The securing mechanism 52 comprises a plurality of straps, including a waist strap 58 and two chest 60 or shoulder straps. Each of the straps (58, 60) may be adjustable to account for various sizes of users to which the board 50 may be secured.

Figure 5A:
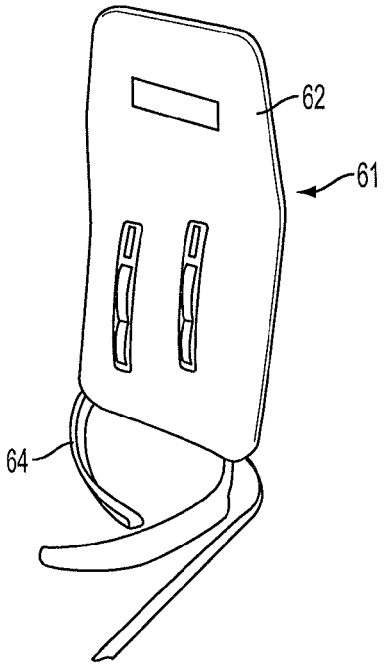
FIG. 5A is a perspective view of a shielding device according to an embodiment of the present invention.

FIG. 5 shows a perspective view of a shielding device 61 that is not being worn by a user. The shielding device 61 may include the same or similar features and/or may be configured to be utilized the same or similar as previously discussed in the above embodiments. The shielding device 61 shown in FIG. 5A is configured as a board 62 a rider wears, to cover the rider's back during transit on a slide ride. A securing mechanism 64 secures the board 62 to the rider when the rider wears the board 62. The board 62 has an outer surface adapted to slide upon a surface of a slide ride, to shield and protect the rider from damage from the surface of the slide ride. The board 62 is sized to fit within a slide ride and will not produce abrasions or damage to the surface of the slide ride when it slides thereupon.

In the embodiment shown in FIG. 5A, the board 62 is shown to comprise a substantially rigid portion of material, which retains its shape after being removed from the rider. This material may comprise foam. The board 62 is lightweight and may be easily worn and removed from the rider. The rider may easily walk while wearing the board 62, without being overburdened by the weight of the board 62 and/or by having the board interfere with the movement of their arms and/or legs. The board 62 may be shaped to be easily held and stored within a shielding device access area or receiving area, for example, one of the respective access areas 30 or receiving areas 32 as previously discussed for FIGS. 1A and 1B. In the embodiment shown in FIG. 5A, the board 62 covers the rider's back and head, without covering the buttocks. The securing mechanism 64 shown in FIG. 5A includes an adjustable waist strap and two chest, or shoulder straps. Each of the straps is adjustable to account for various sizes of riders to which the board 62 may be secured.

Figure 5B:
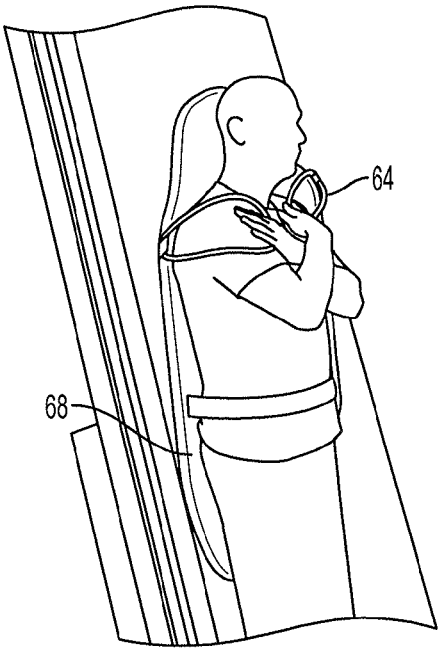
FIG. 5B is a side view of the shielding device of FIG. 5A being worn by a rider according to an embodiment of the present invention.

FIG. 5B illustrates a rider wearing the board 62 shown in FIG. 5A. The rider in this embodiment is positioned within an entry device 66, which may operate the same or similar as previously described in relation to the entry device 14 shown in FIGS. 1A and 1B. In the embodiment shown in FIG. 5B, the entry device 66 comprises a trapdoor mechanism the rider stands upon prior to descending into the slide ride. The rider's back rests against a backrest 68 of the entry device 66, in a manner the same or similar to how the rider's back rests against the surface of the slide ride while the rider traverses the slide ride. Thus, the rider's back is parallel or substantially parallel to the backrest 68 in the same manner that the rider's back is parallel or substantially parallel to the surface of the slide ride while traversing the slide ride. FIG. 5B illustrates how the rider may be permitted to hold grips on the securing mechanism 64 to further retain the board 62 in position once the rider drops through the entry device 66.

FIG. 6 illustrates another embodiment of a shielding device 69 that is not being worn by a user. The shielding device 69 may include the same or similar features and/or may be configured to be utilized the same or similar as previously discussed in the above embodiments. The shielding device shown in FIG. 6 is configured as a board 70 the rider wears to cover the rider's back during transit on a slide ride. A securing mechanism 72 secures the board 70 to the rider when the rider wears the board 70. The board 70 has an outer surface adapted to slide upon a surface of a slide ride, to shield and protect the rider from damage from the surface of the slide ride. The board 70 is sized to fit within a slide ride and will not produce abrasions or damage to the surface of the slide ride when it slides thereupon.

In the embodiment shown in FIG. 6, the board 70 is contoured to fit a rider's back. The board 70 includes outer portions shaped to cover a rider's shoulders and lower back. The securing mechanism 72 is shown to comprise an adjustable waist strap and two chest or shoulder straps. Each of the straps is adjustable to account for various sizes of riders to which the board 70 may be secured.

Figure 7A:
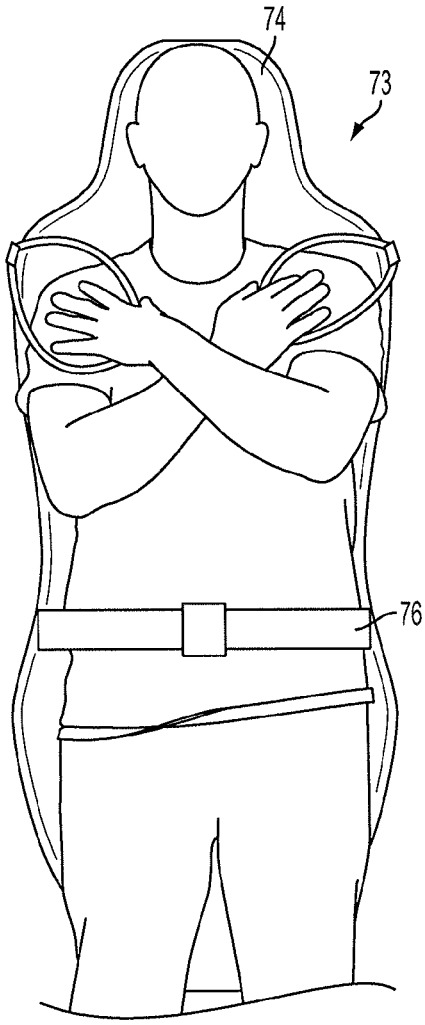
FIG. 7A is a front view of a shielding device according to an embodiment of the present invention.

FIG. 7A illustrates an yet another embodiment of a shielding device 73 being worn by a user. The shielding device 73 may include the same or similar features and/or may be configured to be utilized the same or similar as previously discussed in the above embodiments. The shielding device 73 shown in FIG. 7A is configured as a board 74 the rider wears to cover the rider's back during transit on a slide ride. A securing mechanism 76 secures the board 70 to the rider when the rider wears the board 74. The board 74 has an outer surface adapted to slide upon a surface of a slide ride in order to shield and protect the rider from damage from the surface of the slide ride. The board 74 is sized to fit within a slide ride and will not produce abrasions or damage to the surface of the slide ride when it slides thereupon. In the embodiment shown in FIG. 7A, the board 74 comprises a substantially rigid body that extends above the rider's shoulders to the left and right sides of the rider's head. The securing mechanism 76 comprises an adjustable belt that wraps around the rider's waist.

Figure 7B:
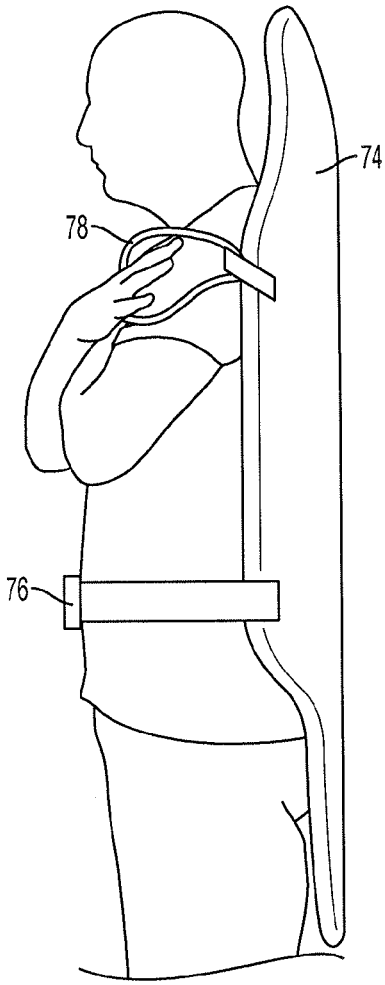
FIG. 7B is a side view of a shielding device according to an embodiment of the present invention.

FIG. 7B illustrates a side view of the board 74 shown in FIG. 7A. The board 74 is shown to have a shape that contours to the rider's body. The board 74 extends from the top of the rider's head down to the rider's knees. A plurality of grips 78 extend from the board 74 for the rider to grab onto while he traverses the slide ride. The grips 78 may help the rider achieve greater control, stability, and/or help maintain the board 74 in a desired position with the rider's body.

Figure 8A:
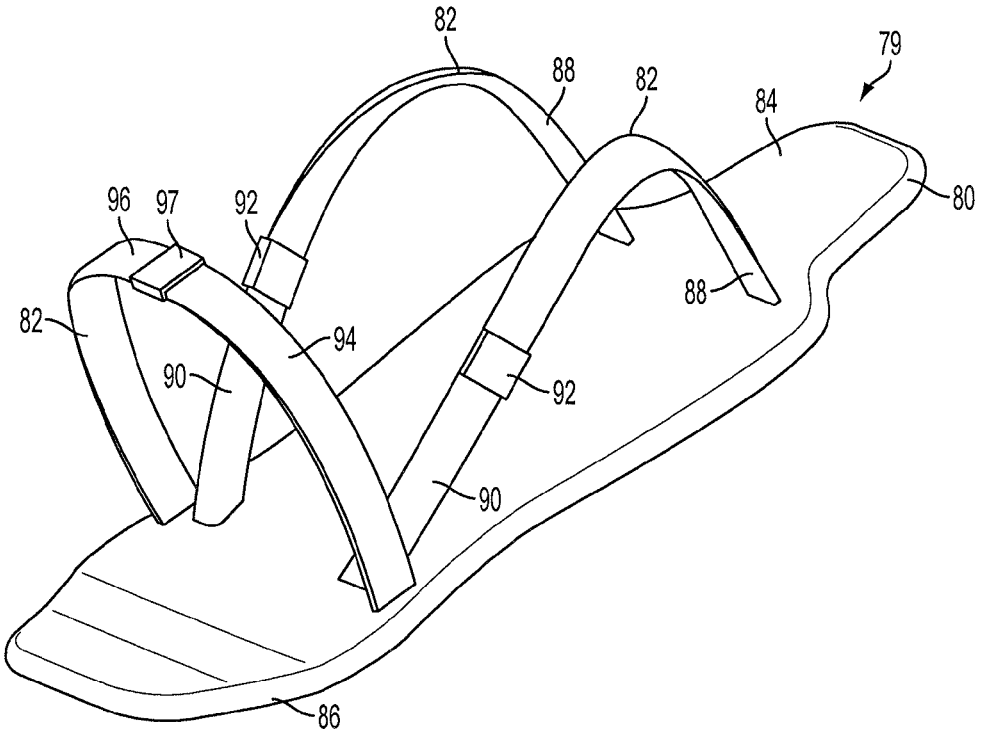
FIG. 8A is a perspective view of a shielding device according to an embodiment of the present invention.

The same or similar to the previous embodiments, FIG. 8A illustrates an embodiment of a shielding device 79. The shielding device 79 may include the same or similar features and/or may be configured to be utilized the same or similar as previously discussed. The shielding device shown in FIG. 8A is configured as a board 80 the rider wears to cover the rider's back during transit on a slide ride. A securing mechanism 82 secures the board 80 to the rider when the rider wears the board 80. The board 80 has an outer surface adapted to slide upon a surface of a slide ride in order to shield and protect the rider from damage from the surface of the slide ride. The board 80 is sized to fit within a slide ride and will not produce abrasions or damage to the surface of the slide ride when it slides thereupon.

The board 80 in FIG. 8A is formed of a contoured body having an upper portion 84, or tailing portion, shaped to cover a rider's head and a lower portion 86, or leading portion, that is angled relative to the remainder of the board 80. The board 80 has sufficient strength for a rider to place his or her upper body weight upon the board without damaging the board 80. The securing mechanism 82 includes two chest, torso, or upper shoulder straps 88 that connect to respective lower shoulder straps 90 with respective buckles 92. The buckles 92 may be configured to be size adjustable to allow the length of the upper straps 88 or lower straps 90 to be adjusted to fit various riders as desired. The securing mechanism 82 includes a first waist strap 94 that connects to a second waist strap 96 via a buckle 97. The buckle 97 may be configured to be size adjustable to allow the length of the first waist strap 94 or second waist strap 96 to be adjusted to fit various riders as desired. Any strap or portion of the securing mechanism 82 may be padded to enhance rider comfort if desired. Belt loops may be included on any portion of the securing mechanism 82 to secure loose straps.

Figure 8B:
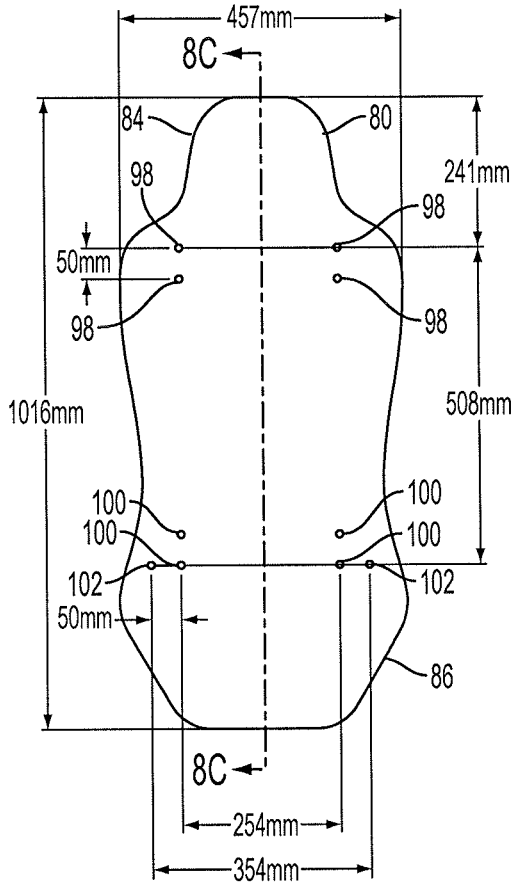
FIG. 8B is a plan view of the shielding device of FIG. 8A according to an embodiment of the present invention.

FIG. 8B illustrates a plan view of the board 80 shown in FIG. 8A. FIG. 8B illustrates exemplary dimensions in millimeters which may be used to define the board 80 shown in FIG. 15. The dimensions shown in FIG. 8B are exemplary and non-limiting, for example, any dimension may be varied to produce a desired result. FIG. 8B illustrates locations of connection points 98, which may be used to secure the upper straps 88 to the board 80. FIG. 8B also illustrates connection points 100, which may be used to secure the lower straps 90 to the board 80. In addition, connection points 102 are shown, which may be used to secure the first waist strap 94 or second waist strap 96 to the board 80. The connection points 98, 100, 102 may be used to secure portions of the securing mechanism 82 to the board 80 using connectors such as rivets, pins, buttons, or the like. The connectors may be formed of non-corrosive materials such as plastic. The connectors may be head sealed to reduce the number of loose threads of the securing mechanism 82.

Figure 8C:
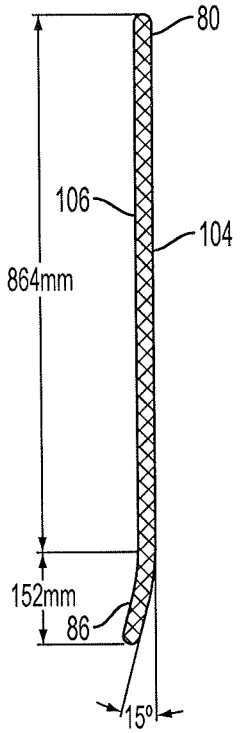
FIG. 8C is a side cross section view of the shielding device of FIG. 8A according to an embodiment of the present invention.

FIG. 8C illustrates a cross section view of the board 80 taken along line A-A in FIG. 8B. Similar to FIG. 8B, the dimensions in FIG. 8C are shown in millimeters, and are exemplary and non-limiting. For example, any dimension may be varied to produce a desired result. FIG. 8C shows an outer surface 104 of the board 80 and comprises a substantially flat surface and an inner surface 106 that comprises a substantially flat surface. The lower portion 86, or leading portion, of the board 80 is angled at fifteen degrees. In an alternative embodiment, the angle of the lower portion 86 may be varied from this exemplary embodiment to produce a desired result.

Figure 8E:
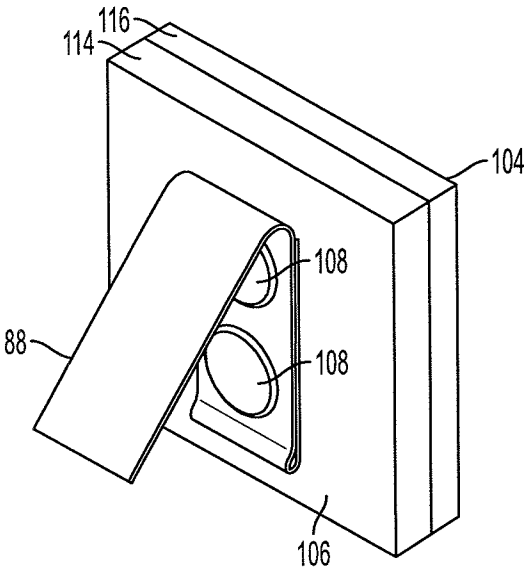
FIG. 8E is a perspective view of a portion of the shielding device of FIG. 8A according to an embodiment of the present invention.
Figure 8D:
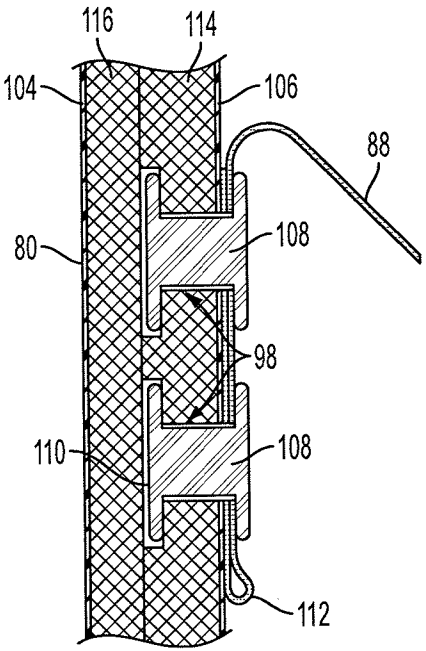
FIG. 8D is a detail cross section view of a portion of the shielding device of FIG. 8A according to an embodiment of the present invention.

FIG. 8D illustrates a detail cross section view of the connection between the upper strap 88 and the board 80 shown in FIG. 8A. FIG. 8D shows the connection points that connect the upper straps 88 and the board 80. Connectors 108 in the form of rivets extend into the inner surface 106 of the board 80 to connect the upper straps 88 thereto. The connectors may include flanged portions 110 that extend into the board 80 to secure the straps 88 in position. A portion 112 of the upper strap 88 is looped upon itself to provide a secure connection to the board 80. Similar connections, using connectors 108 may be used to secure the remaining portions of the securing mechanism 82 to the board 80.

The board 80 is shown having a multi-layered composition. An inner layer 114 of the board 80 may be configured to receive the connectors 108. An outer layer 116 of the board 80 may be laid upon or coupled with the inner layer 114 to secure the connectors in place. The inner layer 114 and/or outer layer 116 may be made of a lightweight material, such as foam or the like. The lightweight material may allow a rider to easily wear the board 80 without bearing substantial weight. The material may allow the board 80 to be sufficiently firm to bear the weight of the rider's upper torso, yet also be durable or flexible enough to prevent the board 80 from breaking during use. In certain embodiments, the lightweight material may comprise EPE foam. The lightweight material may be selected and varied as desired, for example to include various forms of plastics or other cloth materials as desired. The inner layer 114 of the board 80 may be approximately three quarters of an inch thick, although this thickness may be varied as desired in alternative embodiments. The outer layer 116 of the board 80 may be approximately one-half inch thick. This thickness may also be varied as desired in an alternative embodiment. The board 80 is designed to have an overall thickness that allows the rider to enter into a slide ride while wearing the board 80.

In certain embodiments, the outer surface 104 of the board 80 may be coated with a material. The material may improve the ability of the board 80 to slide upon a slide surface, including a waterslide surface. For example, a coating of plastic may be placed on the board 80 to form the outer surface 104 of the board 80. The coating may prevent the board 80 from damaging a slide surface while the rider travels on a slide ride. In one embodiment, the coating may comprise HDPE plastic, although this material may be varied as desired. Similarly, in certain embodiments, the inner surface 106 of the board 80 may also or additionally be coated with a material. The material may improve the comfort of the board 80 when placed upon a rider's back. For example, a coating of plastic may be placed on the board 80 to form the inner surface 106 of the board 80. In one embodiment, the coating may comprise XDPE plastic, although this material may be varied as desired. In embodiments in which the board 80 is used upon a waterslide surface, the coatings formed on or otherwise coupled with the outer surface 104 and/or inner surface 106 of the board 80 may serve to waterproof the board 80.

Figure 8F:
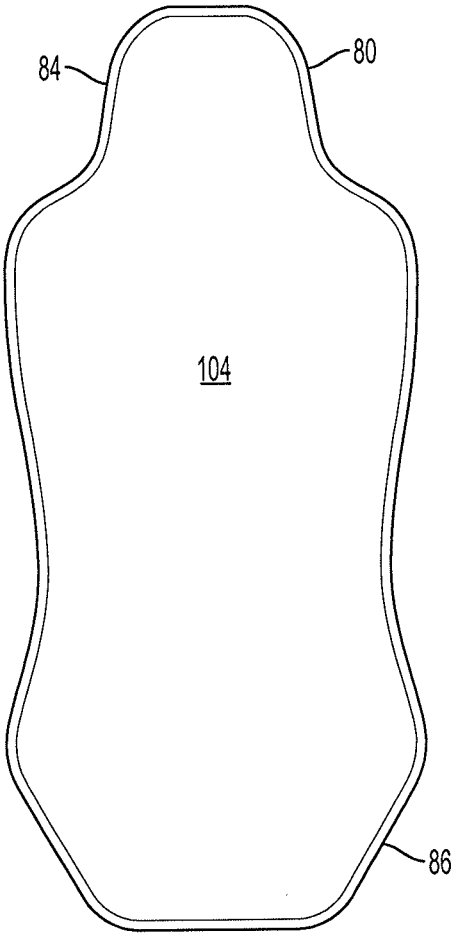
FIG. 8F is a rear view of the shielding device of FIG. 8A according to an embodiment of the present invention.

FIG. 8E illustrates an isometric view of the portion of the board 80 shown in cross section in FIG. 8D. The board 80 is designed to be lightweight enough to be worn by a rider such that the rider can easily walk around while wearing the board. The outer surface 104 of the board is adapted to slide upon a slide surface. For example, the outer surface 104 is designed to smoothly run along a slide surface without damaging the slide surface, and without snagging or snaring on a portion of the slide surface. In addition, the coefficient of friction of the outer surface 104 may be lower than the coefficient of friction of the skin of the rider's back upon the slide surface. Thus, the outer surface 104 may allow the rider to more rapidly descend along a slide than would be possible without use of the board 80. FIG. 8F illustrates a rear view of the board 80 shown in FIGS. 8A-8E. As seen, the outer surface 104 is a substantially smooth surface without protruding elements in order to facilitate smooth sliding over a slide surface.

Figures 1, 9A:
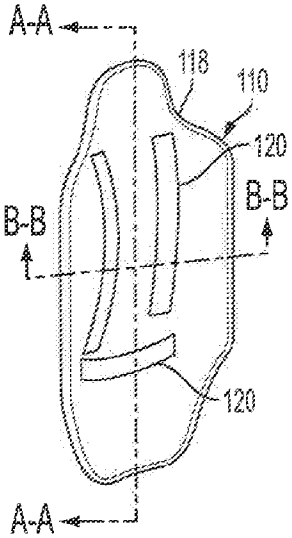

FIG. 9A-1 shows a perspective view of an embodiment of a shielding device 110. The shielding device 110 may include the same or similar features and/or may be configured to be utilized the same or similar as previously discussed. The shielding device 110 shown in FIG. 9A-1 is configured as a board 118 the rider wears to cover the rider's back during transit on a slide ride. A securing mechanism 120 secures the board 118 to the rider when the rider wears the board 118. The board 118 has an outer surface adapted to slide upon a surface of a slide ride to shield and protect the rider from damage from the surface of the slide ride. The board 118 is sized to fit within a slide ride and will not produce abrasions or damage to the surface of the slide ride when it slides thereupon.

In the embodiment shown in FIG. 9A-1, the board 118 has a curved outer surface that may contour to the shape of the slide ride flume the board 118 may ride upon. For example, if the surface of the slide ride is curved at a particular angle, the board 118 may be curved at a corresponding identical, or substantially identical, angle in order to efficiently mate with the surface of the slide ride. The curved outer surface may allow the rider to be more securely held within the slide ride. In addition, the curved outer surface may allow the slide ride to control the path of the rider more easily. The curvature of the outer surface of the board 118 may be varied in various embodiments, as desired. The securing mechanism 120 is show to comprise a plurality of straps that may be used to secure the board 118 to the rider.

FIG. 9A-2 shows a side cross section view of the board 118 of FIG. 9A-1 along line A-A. The dimensions shown are in millimeters and indicate the board 118 may be 971 mm in length. FIG. 9A-3 shows a side cross section view of the board 118 of FIG. 9A-l along line B-B. The dimensions shown are in millimeters and indicate the board 118 may be 514 mm in width with a curvature that raises the ends of the board 102 mm from a plane containing a middle portion of the board 118. The dimensions disclosed are exemplary and non-limiting, thus, in an alternative embodiment, any of the dimensions shown in FIGS. 9A-1-9A-3 may be varied to produce a desired result or configuration.

Figure 9C:
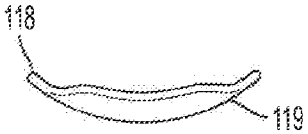
FIG. 9C is a bottom view of the shielding device of FIG. 9A-1 according to an embodiment of the present invention.
Figure 9B:
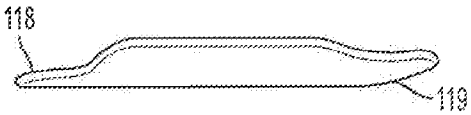
FIG. 9B is a side view of the shielding device of FIG. 9A-1 according to an embodiment of the present invention.

FIG. 9B illustrates a side view of the board 118 shown in FIG. 9A-1. FIG. 9B illustrates a lower portion 119, or leading portion, of the board 118 is angled relative to the remainder of the board 118. The angled lower portion 119 allows the board 118 to more easily change direction when traveling on the slide ride surface. FIG. 9C illustrates a bottom view of the board 118 to also show the angled lower portion 119.

Figure 10:
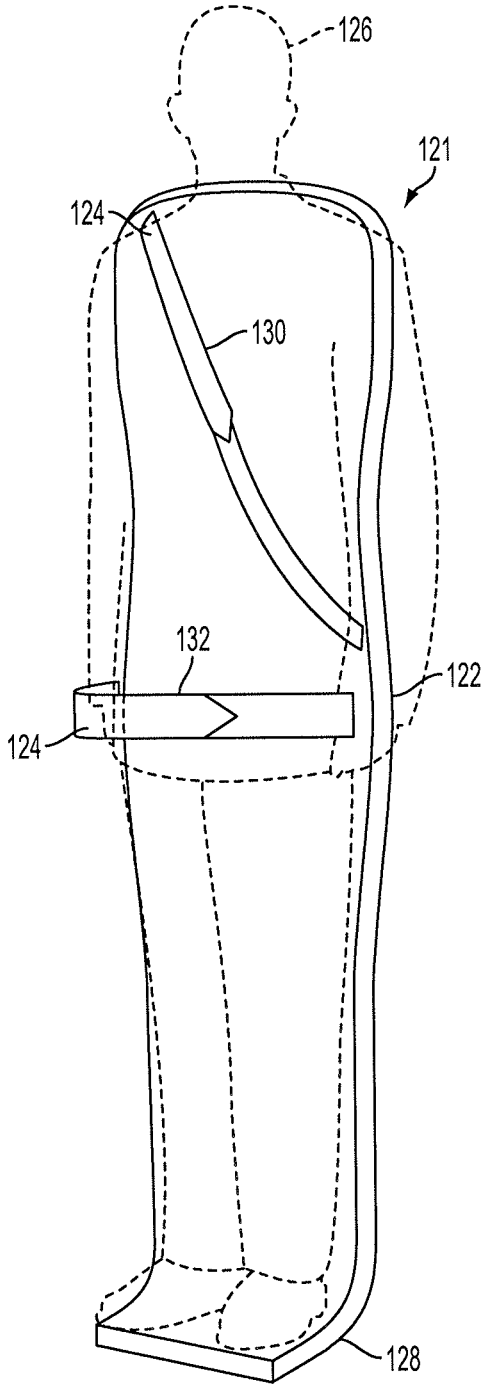
FIG. 10 is a perspective view of a shielding device according to an embodiment of the present invention.

FIG. 10 illustrates an embodiment of a full-bodied shielding device 121 to be worn by a rider. The shielding device 121 may include the same or similar features and/or may be configured to be utilized the same or similar as previously discussed. The shielding device 121 shown in FIG. 10 is configured as a board 122 the rider wears in order to cover the rider's back and legs during transit on a slide ride. A securing mechanism 124 secures the board 122 to the rider when the rider wears the board 122. The board 122 has an outer surface adapted to slide upon a surface of a slide ride to shield and protect the rider from damage from the surface of the slide ride. The board 122 is sized to fit within a slide ride and will not produce abrasions or damage to the surface of the slide ride when it slides thereupon.

The board 122 shown in FIG. 10 extends downward to cover the legs and feet of a rider 126 shown in outline form. The board 122 includes a foot portion 128 configured to extend below the feet of the rider 126 of the slide ride. In this manner, the rider 126 may step on the board 122 prior to descending into the slide ride, and may have his or her feet protected while traveling through the slide ride. In certain embodiments, the board 122 may be made flexible at the foot portion 128 to allow a rider to more easily walk while wearing the board 122. The securing mechanism 124 shown in FIG. 10 includes a diagonal-positioned chest strap 130 and waist strap 132 that secure the board 122 to the rider 126. The chest strap 130 and or waist strap 132 may be secured to the rider 126 through any of the means discussed throughout this application, including a buckle, belt loop, Velcro, snap connectors, or the like.

Figure 11A:
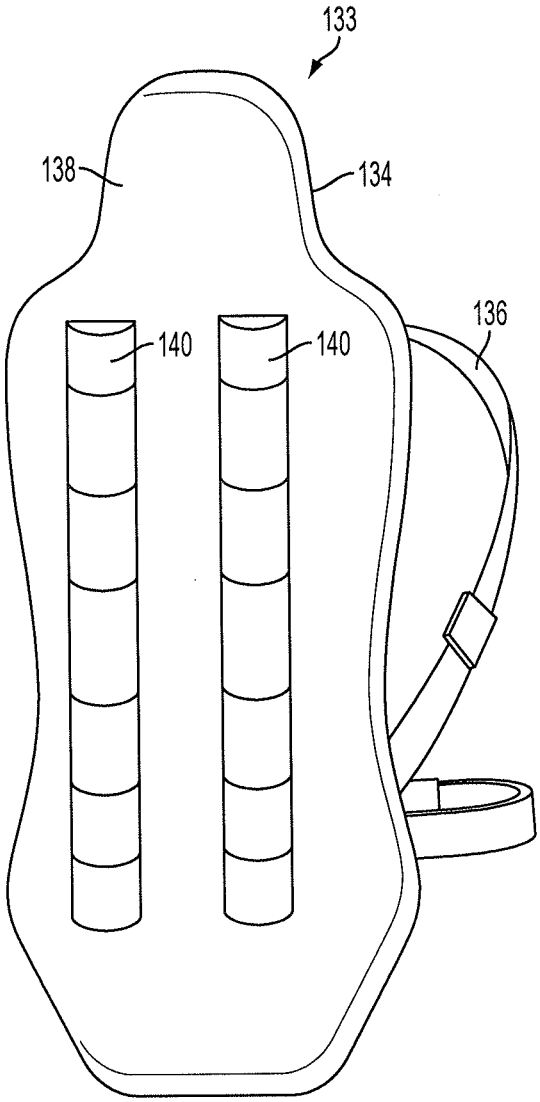
FIG. 11A is a rear perspective view of a shielding device according to an embodiment of the present invention.
Figure 11B:
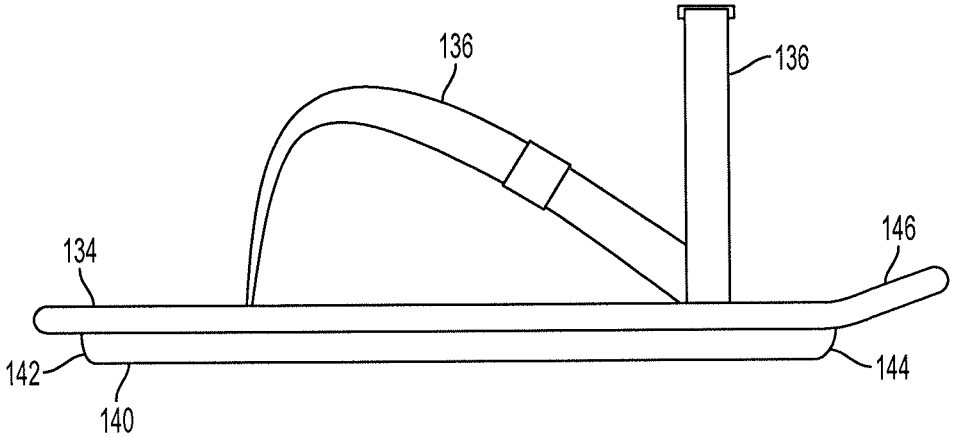
FIG. 11B is a side view of a shielding device according to an embodiment of the present invention.

FIG. 11A illustrates yet another embodiment of a shielding device 133. The shielding device 133 may include the same or similar features and/or may be configured to be utilized the same or similar as previously discussed. The shielding device 133 shown in FIG. 11A is configured as a board 134 the rider wears in order to cover the rider's back during transit on a slide ride. A securing mechanism 136 secures the board 134 to the rider when the rider wears the board 134. The board 134 has an outer surface 138 adapted to slide upon a surface of a slide ride to shield and protect the rider from damage from the surface of the slide ride. The board 134 is sized to fit within a slide ride and will not produce abrasions or damage to the surface of the slide ride when it slides thereupon.

In the embodiment shown in FIG. 11A, the board 134 has the outer surface 138 shaped with raised portions 140 that serve as runners or rails for the board 134 to slide upon. The raised portions 140 reduce the friction exerted against the board 134 by the slide ride surface to allow the board 134 to more rapidly slide along the slide ride surface. Although the raised portions 140 are shown in FIG. 11A to comprise longitudinal runners extending along the board 134, in other embodiments the raised portions 140 may be oriented in any shape, for example, a series of bumps, or regular or irregular grooves, as desired. The raised portions 140 may be made of the same material as the board 134 or different materials. The securing mechanism 136 shown in FIG. 11A may, for example, be configured identically as the securing mechanism 82 shown in FIG. 8A.

Figure 11C:
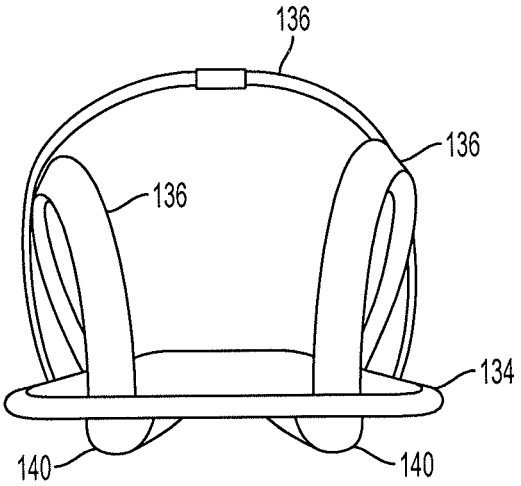
FIG. 11C is a top view of a shielding device according to an embodiment of the present invention.

FIG. 111 is a side view of the board 134 shown in FIG. 11A. The height of the raised portions 140 relative to the remainder of the board 134 is visible. The raised portions 140 may be positioned at an angle relative to the remainder of the board 134, for example, with a tailing end portion 142 at less of a distance from the board 134 than a leading end portion 144. A lower end portion 146 of the board may be at an angle relative to the remainder of the board. The angle or orientation of any part of the raised portion 140 may be varied as desired. FIG. 11C illustrates a top view of the board 134 shown in FIG. 11A. The raised portions 140 are shown extending down toward the leading edge of the board 134.

In any of the above discussed embodiments, the features of the various boards may be interchanged or varied as desired. The boards may be made rigid, semi-rigid, or flexible, to produce a desired amount of rigidity or flexibility for the board. The materials of the boards may be varied as desired to vary the durability or weight of the boards. In certain embodiments, an entirety or a portion of the boards may be deformable to provide a cushion, or greater cushioning for the rider. The size and coverage of the boards may be varied to cover only a portion of the back, or the entirety of the back, and/or the head and/or the buttocks and/or the entire body. The surfaces of the boards may be varied as desired, to provide different coefficients of friction, to either increase or decrease the rate of travel of the rider, as desired. In embodiments in which the board is used with a waterslide, the board may be made suitable for UV exposure and for exposure to chlorinated water. In embodiments in which the board is used with a waterslide, the board may be made waterproof and/or buoyant. The securing mechanisms may include straps, flanges, buckles, webbing, cords, clasps, or the like, to secure the board to the rider. The boards may be made size adjustable to account for various sizes of riders to which the boards are secured. The securing mechanisms may be size adjustable, through use of slides or buckles, or the like to produce a variety of size adjustable securing mechanisms. In certain devices, the boards may include grip devices to give the rider a device to hold onto while traversing the slide ride, and to position the rider's arms in the desired location.

The shielding devices are not limited to only the boards explicitly discussed throughout this application. In certain embodiments, the shielding devices may be configured as any device that shields the back or other portion of a body of a rider (e.g., head, neck, legs, feet, etc.) and is capable of sliding along a slide surface, or waterslide surface, for example as shown in FIGS. 1A-1D. The ride, slide, or waterslide surface may use any of a variety of configurations, such as flat slides, closed flumes, open flumes, bowl elements, frustoconical elements, vertical walls, etc. Moreover, although riders are described as traversing the sliding surface face-up and feet-first, shielding devices in alternative embodiments may be configured to allow riding on the sliding surface in any of a variety of positions (e.g., face-down, face-first, on a rider's side, standing up, etc.).

In certain embodiments, the shielding devices may comprise mats, pads or vests that a rider may wear, to shield the rider's back, or other portions of the rider's body, during transit on the waterslide ride. The shielding devices may be manufactured with any of a variety of materials and/or may have any of a variety of coatings disposed thereon. For example, a coating or material with a low coefficient of friction and/or for a more comfortable feel may be disposed (e.g., sprayed, painted, impregnated, etc.) onto or into one or more surfaces or areas of the shielding device. Thus, different coatings or materials may be used for different portions of a given shielding device. For example, if a shielding device utilizes protruding elements or rails/runners, a different coating or material may be utilized in conjunction with those protruding elements than for other parts of the shielding device.

The aesthetic design of any of the shielding devices may be varied as desired, to include theming and the like. Any of a variety of manners for coupling a board or other component of the shielding device to a rider may be used (e.g., straps, hand-holds, ties, cut-outs, clips, belts, snaps, etc.) Alternative embodiments of the shielding device may also utilize a board that is not a single, solid, or contiguous piece. For example, one embodiment of a shielding device may utilize a board made of multiple rigid or semi-rigid elements that are fastened together via straps, ropes, etc. to allow for further movement by the rider. In another embodiment, a shielding device may have holes or other cut-outs therein to reduce the weight of the shielding device and/or make it more flexible. Furthermore, alternative embodiments may be extendible and/or adjustable to allow for riders of different heights or widths to adjust the shielding device as appropriate to adequately shield one or more portions of their body.

Methods of allowing a rider's back to be shielded while traveling on a slide ride surface may comprise any of the methods discussed throughout this application. Such methods may include providing any component or feature of slide rides, or shielding devices discussed throughout this application, or operating any component of the slide rides or shielding devices discussed throughout this application.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A device for shielding at least a portion of a body of a rider from a ride surface comprising:

a board configured to be coupled with the body of the rider, the board having:

an outer material, a protruding element coupled with the outer material at a portion of the outer material located between two opposing edges of the outer material for making contact with the ride surface, a treatment for at least a portion of the outer material, the treatment having a lower coefficient of friction than the outer material for sliding on the ride surface, an inner material coupled to the outer material for covering the at least a portion of the body of the rider when the rider is coupled with the board, and wherein the board is curved such that a first point at an edge of the outer material of the board is disposed at a fixed angle from a second point not along the edge of the outer material of the board; and a securing mechanism coupled to the board for coupling the board to the rider.

2. The device of claim 1 wherein the at least a portion of the body of the rider is the back of the rider.

3. The device of claim 2 wherein the securing mechanism includes a first strap configured to be disposed adjacent to the waist of the rider when the rider is coupled with the board.

4. The device of claim 3 wherein the securing mechanism includes a second strap configured to be disposed adjacent to a first shoulder of the rider when the rider is coupled with the board and a third strap configured to be disposed adjacent to a second shoulder of the rider when the rider is coupled with the board.

5. The device of claim 4 wherein any of the first strap, the second strap, or the third strap is size adjustable.

6. The device of claim 5 wherein any of the first strap, the second strap, or the third strap is size adjustable via a buckle.

7. The device of claim 1 wherein the second point not along the edge of the outer material of the board is located on a flat portion of the board.

8. The device of claim 1 wherein the board is curved such that a third point at a second edge, positioned opposite the first edge, is disposed at a fixed angle from the second point.

9. The device of claim 1 wherein the protruding element comprises a plurality of rails in parallel with one another.

10. The device of claim 1 further comprising a grip coupled with the securing mechanism configured to be held by the rider when the board is coupled with the rider.

11. The device of claim 1 wherein the board is flexible for allowing the board to contour to the shape of the at least a portion of the body of the rider.

12. The device of claim 1 wherein the board does not extend below the knees of the rider when the board is coupled to the rider via the securing mechanism.

13. The device of claim 1 wherein the outer material is different from the inner material.

14. The device of claim 1 wherein the protruding element is formed as part of the outer material.

15. The device of claim 1 wherein the treatment is a coating applied to the at least a portion of the outer material.

16. The device of claim 1 wherein the treatment is impregnated with the at least a portion of the outer material.

17. A device for shielding a user from a ride surface comprising:

a board configured to be coupled with a body of the user and having a first curved portion that is fixedly curved from a middle portion of the board and a second curved portion disposed on an opposite side of the board from the first curved portion, the board having an outer surface with at least one protrusion positioned at least partially between opposing edges of the outer surface for making contact with the ride surface, at least a portion of the outer surface treated with a low friction treatment, the treatment having a lower coefficient of friction than the outer material for sliding on the ride surface, and an inner surface not treated with the low friction treatment, the inner surface configured to cover the at least a portion of the user if the user is connected with the board; and a securing mechanism connected with the board for connecting the board with the user, wherein the board does not extend past the knees of the user if the user is coupled with the board via the securing mechanism.

18. A device for shielding at least a portion of a body of a rider from a ride surface comprising:

a board configured to be coupled with the body of the rider, the board having:

an outer material wherein a first portion of the outer material has a lower coefficient of friction than a second portion of the outer material, a protruding rail coupled with the outer material and located between opposing edges of the outer material for making contact with the ride surface, an inner material coupled to the outer material for covering the at least a portion of the body of the rider when the rider is coupled with the board, and wherein the board is curved such that a first point at an edge of the outer material of the board is disposed at a fixed angle from a second point not along the edge of the outer material of the board; and a securing mechanism coupled to the board for coupling the board to the rider.

* * * * *